US008373574B2

(12) United States Patent
Gebhard

(10) Patent No.: US 8,373,574 B2
(45) Date of Patent: Feb. 12, 2013

(54) COUNTER TOP BEVERAGE CHILLER WITH ADVERTISING INDICIA AND RELATED ADVERTISING METHODS

(76) Inventor: Albert W. Gebhard, Denver, CO (US)

( * ) Notice: Subject to any disclaimer, the term of this patent is extended or adjusted under 35 U.S.C. 154(b) by 0 days.

(21) Appl. No.: 13/256,620

(22) PCT Filed: May 3, 2010

(86) PCT No.: PCT/US2010/033425

§ 371 (c)(1),
(2), (4) Date: Sep. 14, 2011

(87) PCT Pub. No.: WO2010/127357

PCT Pub. Date: Nov. 4, 2010

(65) Prior Publication Data

US 2012/0005130 A1 Jan. 5, 2012

Related U.S. Application Data

(60) Provisional application No. 61/174,839, filed on May 1, 2009, provisional application No. 61/233,756, filed on Aug. 13, 2009.

(51) Int. Cl.

| | |
|---|---|
| ***G08B 3/00*** | (2006.01) |
| ***B67D 7/80*** | (2010.01) |
| ***F21V 33/00*** | (2006.01) |
| ***B65D 6/28*** | (2006.01) |

(52) U.S. Cl. ..... 340/691.1; 340/691.3; 340/691.4; 340/691.5; 340/500; 222/146.6; 222/113; 222/185.1; 362/154; 362/101; 362/234; 362/362; 362/812; 220/4.21; 220/509; 705/500

(58) Field of Classification Search ..... 340/691.1, 340/691.5, 691.3, 500, 691.4; 222/146.6, 222/113, 185.1, 192, 25, 39, 394; 362/154, 362/101, 234, 240, 253, 362, 812; 220/4.21, 220/4.22, 4.23, 4.24, 509
See application file for complete search history.

(56) References Cited

U.S. PATENT DOCUMENTS

| | | | | |
|---|---|---|---|---|
| 5,058,393 | A | 10/1991 | Callon et al. | |
| 5,908,142 | A * | 6/1999 | Sacchetti | 222/25 |
| 7,206,618 | B2 * | 4/2007 | Latto et al. | 455/575.8 |

(Continued)

FOREIGN PATENT DOCUMENTS

| | | |
|---|---|---|
| KR | 20-0242113 Y1 | 10/2001 |
| KR | 20-0393213 Y1 | 8/2005 |

OTHER PUBLICATIONS

Written Opinion of the International Searching Authority dated Jan. 29, 2011 for the parent PCT application.

(Continued)

*Primary Examiner* — Daniel Wu
*Assistant Examiner* — Mancil Littlejohn
(74) *Attorney, Agent, or Firm* — Margaret Polson; Oppedahl Patent Law Firm LLC

(57) ABSTRACT

A device and advertising method utilizes a sound and light display device, which often holds a bottle of a beverage to be dispended, and customer based remote which is distributed to customers in any number of ways. In one embodiment the sound playing device can be incorporated into a chiller. In one embodiment the sound playing device is incorporate into a stand for the beverage bottle. Other display devices are also possible. Examples include, but are not limited to, a small audio sound playing device, a beverage sign or sculpture which also evokes the brand. More than one type of remote can be created, allowing different types of customers to have different control levels or access to different areas of an establishment.

20 Claims, 4 Drawing Sheets

U.S. PATENT DOCUMENTS

| | | | | |
|---|---|---|---|---|
| 7,775,355 | B1 * | 8/2010 | Hood | 206/320 |
| 2003/0210141 | A1 * | 11/2003 | Iacovino | 340/539.1 |
| 2009/0057340 | A1 * | 3/2009 | Moothart | 222/113 |
| 2009/0063274 | A1 * | 3/2009 | Dublin et al. | 705/14 |
| 2009/0182444 | A1 * | 7/2009 | Welch | 700/94 |

OTHER PUBLICATIONS

International Search Report dated Jan. 29, 2011 for the parent PCT application.

* cited by examiner

COUNTER TOP BEVERAGE CHILLER WITH ADVERTISING INDICIA AND RELATED ADVERTISING METHODS

CROSS REFERENCE APPLICATIONS

This application is a non-provisional application claiming the benefits of provisional application no. 61/174,839 filed May 1, 2009 and application no. 61/233,756 filed Aug. 13, 2009, both of which are hereby incorporated by reference in their entirety.

BACKGROUND

As the beverage market is intensely competitive, new ways to build brand awareness and loyalty are always being sought. This is particularly true in bars and restaurants, where people have the opportunity to try new beverages. The Brand owners want to be sure people are aware of which beverage they are drinking at such establishments, so that brand awareness and loyalty are built.

The foregoing example of the related art and limitations related therewith are intended to be illustrative and not exclusive. Other limitations of the related art will become apparent to those of skill in the art upon a reading of the specification and a study of the drawings.

SUMMARY

A counter top beverage chiller with one or more advertising indicia that can be activated by remote control is disclosed.

An alternate embodiment is a display that calls attention to the brand in some way that may or may not include a beverage dispenser.

The following embodiments and aspects thereof are described and illustrated in conjunction with systems, tool and methods which are meant to be exemplary and illustrative, not limiting in scope. In various embodiments, one or more of the above described problems have been reduced or eliminated, while other embodiments are directed to other improvements.

Beverage chillers, particularly chillers for alcohol are well known. Many people like to have their beverage, particularly alcoholic beverages, served very cold, but they do not want the beverage diluted with water from melting ice. This is particularly true of so called hard liquors, such as vodka, gin, and various flavored liqueurs. The disclosed chiller utilizes the original beverage container to store the beverage while keeping the beverage container visible. The outer surface of the chiller is decorated and provided with advertising indicia and attention attracting features. In one embodiment the chiller is designed to look like a block of ice. This chiller design combined with the beverage container acts as a suggestion to viewers that the beverage is, or could be, served cold. A display feature including an audio feature and/or a light feature allows sounds or other displays that evoke the brand to be activated when the beverage is dispensed, when a customer uses a remote to order a beverage, at times chosen by staff, and/or at random times. The audio and light features could also be incorporated into a beverage tap handle on a bar, such as a beer tap.

An alternate embodiment of the advertising method utilizes a customer based remote which is distributed to customers in any number of ways and can activate the sound. In one embodiment the sound playing device can be incorporated into a device other than a chiller. Examples include, but are not limited to, a small audio sound playing device, a beverage sign or sculpture which also evokes the brand.

In addition to the exemplary aspects and embodiments described above, further aspects and embodiments will become apparent by reference to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION OF THE DRAWINGS

Figure 1:
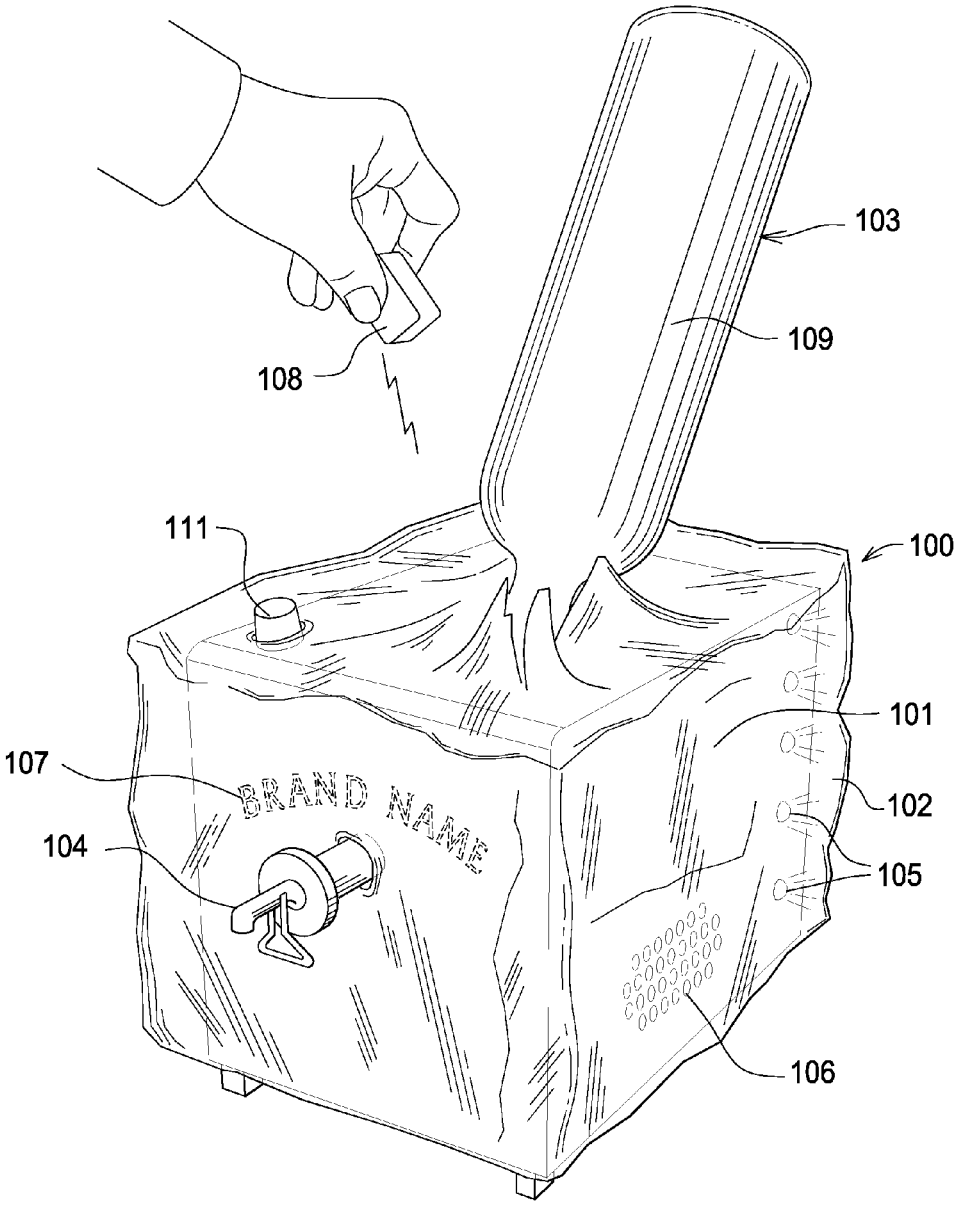
FIG. 1 is a perspective view of a chiller with a beverage container extending from the top of the chiller.

Referring to FIG. 1, the main body of a chiller 100 is designed to rest on a counter top or shelf where it will be visible to consumers. A number of chiller designs, including ice buckets, are well known in the art, and therefore will not be further described. Any known or newly developed method of chilling a beverage is included in the scope of this disclosure. A case 101 contains the chiller 100 components. A beverage container 103 (generally a bottle) is connected to the chiller to allow the beverage to flow into the chiller to be chilled and to be dispensed via the spigot 104. In the depicted embodiment, the beverage container 103 is inserted into an opening on the top mostly inverted to allow the beverage to flow out of the container 103 into the interior of the chiller 100. Other methods of connecting the container 103 to the chiller 100 could be used as well, including, but not limited to siphons, pumps or other connections. The beverage container does not have to remain visible, unless this is desired for advertising purposes.

Although alcoholic beverages are discussed, the disclosure is not limited to alcoholic beverages. Any other beverages, including but not limited to, energy drinks, soda, premium water or other beverages could be promoted using the disclosed methods as well.

The outer surface 102 is formed to look like a block of ice in the depicted embodiment. Other designs could be chosen to evoke the brand of beverage, or to echo the decorating theme of the establishment, or other design choices. To further support the beverage container 103 the surface 102 can be formed up around the neck 104 of the beverage container 103. This can be used to support the beverage container 103 at a specific angle and/or orientation which allows easy flow of the liquor and/or ensures that the label 109 of the beverage container 103 is visible. The outer surface 102 could be formed to reflect the specific trade dress of the beverage, the temperature lowering feature, a current advertising theme or any other desired theme. If desired a brand indicia 107 can be placed on the outer surface 102. This could be for the beverage, the serving establishment, or any other desired brand indicia. In some instances the outer surface 102 may be a removable cover, to allow for new adverting campaigns to be utilized or to allow the chiller 100 to be used with different beverages.

Lights 105 can be incorporated into the outer surface 102 to further draw attention to the chiller. The lights 105 can have a color, layout pattern, and/or pattern of illumination (blinking) that coordinate with the theme and/or attract attention when activated as discusses below. The lights could also act independently of any activation to highlight the chiller 100 and the beverage being dispensed.

The chiller 100 has an audio speaker 106 connected to an audio play back device (not shown) to play a sound or sounds. The audio playback device could be any one of a number of devices, including, but not limited to, MP3 player, CD player, tape or other device. The audio playback device can have one or more audio tracks that are played on command. The audio tracks can be programmed into the audio playback device, or the audio playback device can have a removable medium that holds the audio recordings. The removable medium could be, but is not limited to, CDs, audio tapes, flash memory chips or any other removable medium. The sounds can coordinate with the brand of beverage, the current advertising campaign for the beverage and/or the theme for the serving establishment. For example, if a particular song was being used in advertisements for the beverage, then the chiller 100 could play the song, or if a particular animal was used in the advertising and/or branding, then the sounds associated with that animal could be used. Any other desired audio track could be used as well.

The sounds could be activated when the beverage is dispensed, when activated by the bartender and/or when activated by a customer who desires to order the beverage. If desired, different sounds and/or light displays could be used for different activations. So that one noise/light display indicated a customer order, while a different noise/light display indicates that the beverage is being dispensed. Further displays could be used to indicate any desired condition, such as the container 103 being almost empty, when a new container 103 has been place in the chiller 100, last call or any other desired event.

Well known remote control technology is used to allow the sounds and/or the light to be activated by a remote control 108 from a distance for any of the desired uses. The remote control could use radio frequencies, light or sound, depending on the price point and control desired. For example, simple whistles which emit sound above the human auditory range may be more desirable than a standard radio frequency control as this would make the giveaway remotes significantly less expensive. Or an infrared light control or laser pointer could also be used as well. No limitation on the type of remote control device should be inferred.

Different remote controls 108 can be given to different people, allowing different levels of control over the device. For example, a location may have VIP customers that the location wishes to have special privileges. These people could have different controls 108 from standard customers. If the chiller 100 has a setting that allows customers to activate the audio track and/or the light display it may be desirable to have a "reset" time during which the audio track and/or the light display cannot be activated, to prevent the customers overplaying the audio track and/or the light display. This reset time could be random, predetermined, or variable, depending on how frequently the noise has been played, the number of activations from a single remote, or any other chosen parameter. There may be a control that allows the bartender to deactivate a given remote if a customer was being a nuisance; if the person has reached the bar's serving limit or any other desired reason. This control could either be on the chiller 100 or a separate control box located remotely from the chiller 100. If the customer can use a remote 108 to order a beverage, then a control panel either on the chiller 100 or on the separate control box could have a display panel to show the server which table and/or customer number has ordered a given beverage.

The chiller 100 could have off switches for the lights and/or the sounds so that displays can be completely deactivated if desired, for example during a concert or other performance at the dispensing location.

The remote controls 108 can have a surface decoration that evokes the beverage name, the establishment name, or a sponsor name if the chiller 100 or other display was at a sponsored event, such as a sporting event. The remote control 108 could be either attached to, or incorporated in a bottle opener or other promotional item. Different types of remotes could be incorporated into different promotional items, so that there is an immediate visual difference between the different types of remotes. The remote controls 108 can be distributed by the establishment owner, the beverage company or any other desired entity. For example, the beverage company could attach the remote controls 108 to bottle of the beverage sold in stores so that purchasers can then order the beverage in a drinking establishment with the chiller 100.

The remote controls 108 could be given away at promotional events, or customers could order remotes on the beverage webpage or other similar location. This would allow the beverage company to hand out remote controls 108 to promote customer loyalty by allowing the customer to order that particular brand at a establishment having bought a bottle of the beverage at the store. Alternatively, the remote controls 108 could be used to authorize the customer to a free or reduced price beverage at participating establishments. Special mixed drinks or premium beverages could be available only to customers with specific remote controls. Or special remote controls could allow the holder access to special areas of an establishment, so that VIP customers could be given automatic access to specific areas. In another embodiment the remote controls 108 could be given away as part of a sweepstakes promotion, where a given number of remotes less than the total number of remotes entitle the bearer to a prize or prizes. Alternatively, the controls of the overall system could have a setting that awards prizes randomly, so every X number of activations of the control box is a prize winner, with the number X varying as chosen by a random number generator or other known means. Additionally, prize winning remotes could be made in advance with a specific ID built into the device, to allow them to be redeemed later at a location, similarly to lottery tickets. The winning ID could be a bar code or other ID method printed on the remote 108, or could be intergrated into the remote control signal that would cause a specific sound and/or light display when activated. The prize remotes could have to be redeemed at specific locations and/or within specific times.

Another embodiment of the advertising method could have the audio track and/or light display built into a device other than a chiller 100, to allow the remote controls 108 to be used at establishments that do not have space on the bar for a chiller 100. The device could be a standard lighted bar sign, a sculpture or any other desired device. Alternatively, the audio and/or sound displays and the remote control receiver could be included in a handle of a beverage tap, which are already often custom-shaped for a given brand of beverage, particularly beer.

Figure 2:
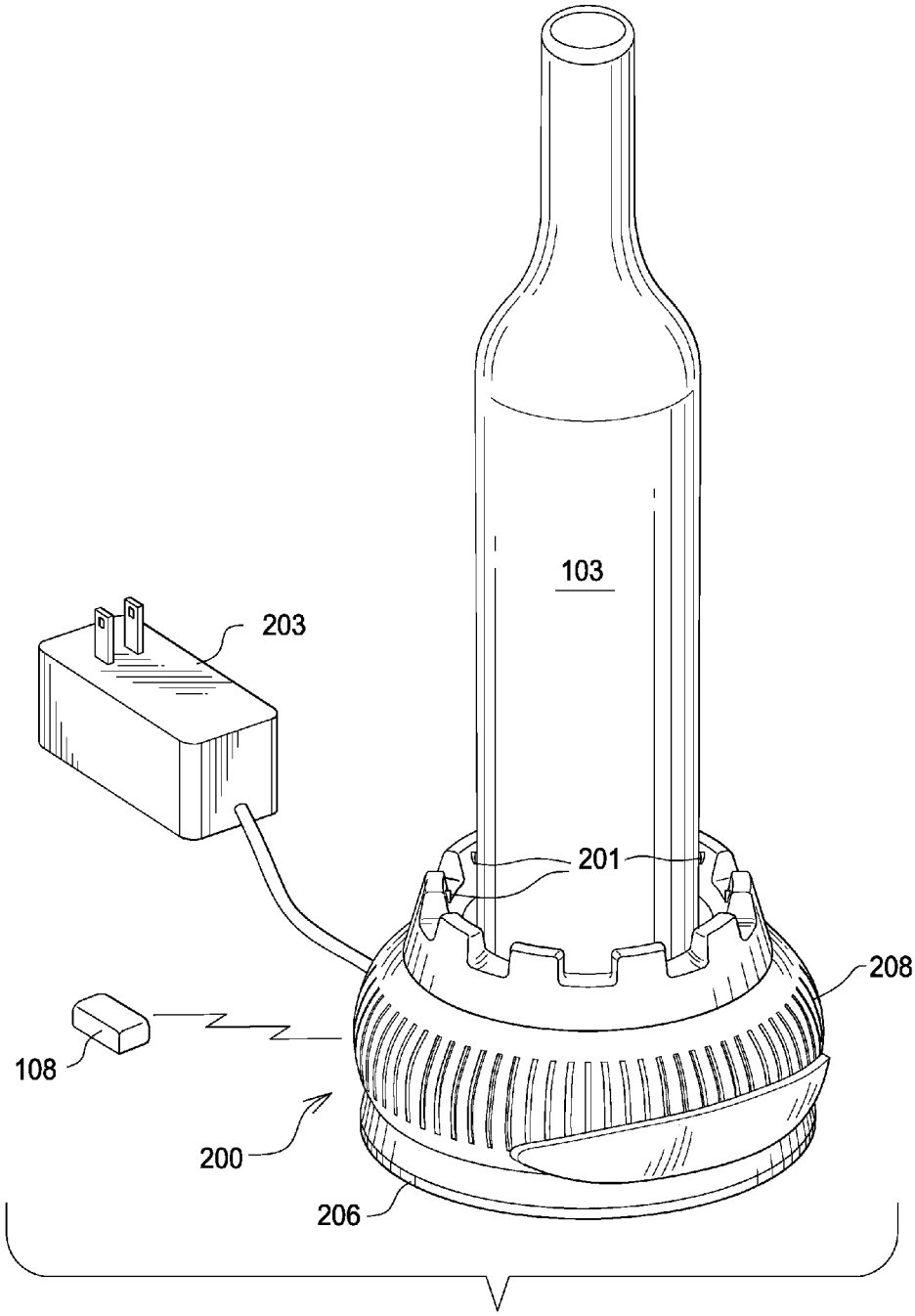
FIG. 2 is a perspective view of a display stand alternate embodiment.

FIG. 2 is a perspective view of an alternate embodiment for use when a chiller is not needed and/or desired. A display stand 200 for the beverage container 103 can be used instead, in addition to the possibilities mentioned above. The display stand allows the beverage container 103 to be raised such that it is above or otherwise more prominent than other beverage containers on the bar or other display area. The display stand 200 can connect to a power supply 203 or have batteries or a combination of both.

The display stand 200 can have lights 201 and/or an audio speaker 202 that are activated by the remote control 108. The lights 201 can be LED's or other light sources. The lights 201 have control mechanisms so they can be turned on and off as desired, included patterned displays of lights or other light displays. There can be more than one color of light to allow for different displays. The different types of remotes and/or commands from a remote noted above can be set to have different light/sound displays that the remote activates, to allow for any of the uses described above.

The display stand 200 has an audio play back device 205 connected to an audio speakers 202 to play a sound or sounds. The audio playback device could be any one of a number of devices, including, but not limited to, MP3 player, CD player, tape or other device. The audio play back device can have one or more audio tracks that are played on command. The combination of light displays and particular audio track can be used to increase the number of possible different combinations of sound and light displays created by the display stand 200.

Figure 3:
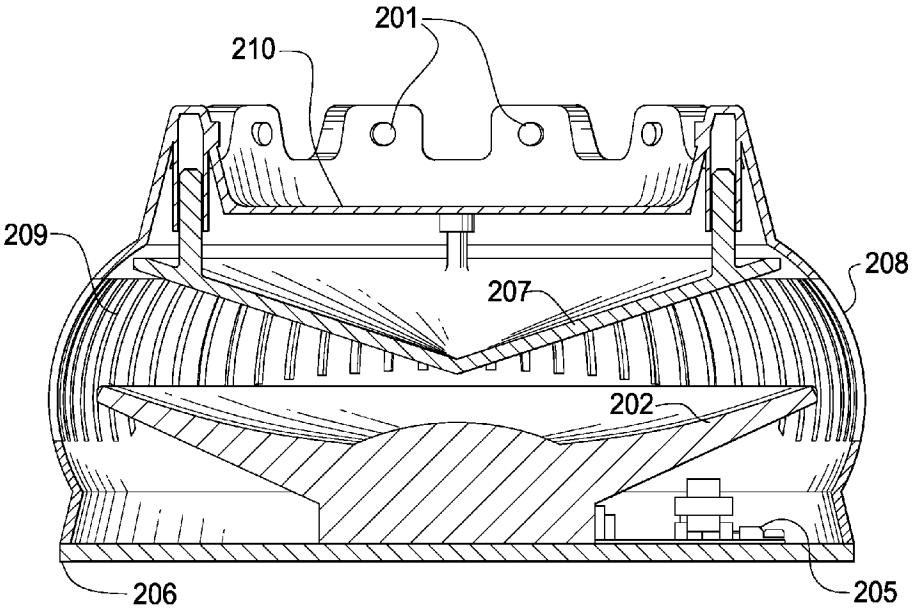
FIG. 3 is a cross-sectional view the display stand.
Figure 4:
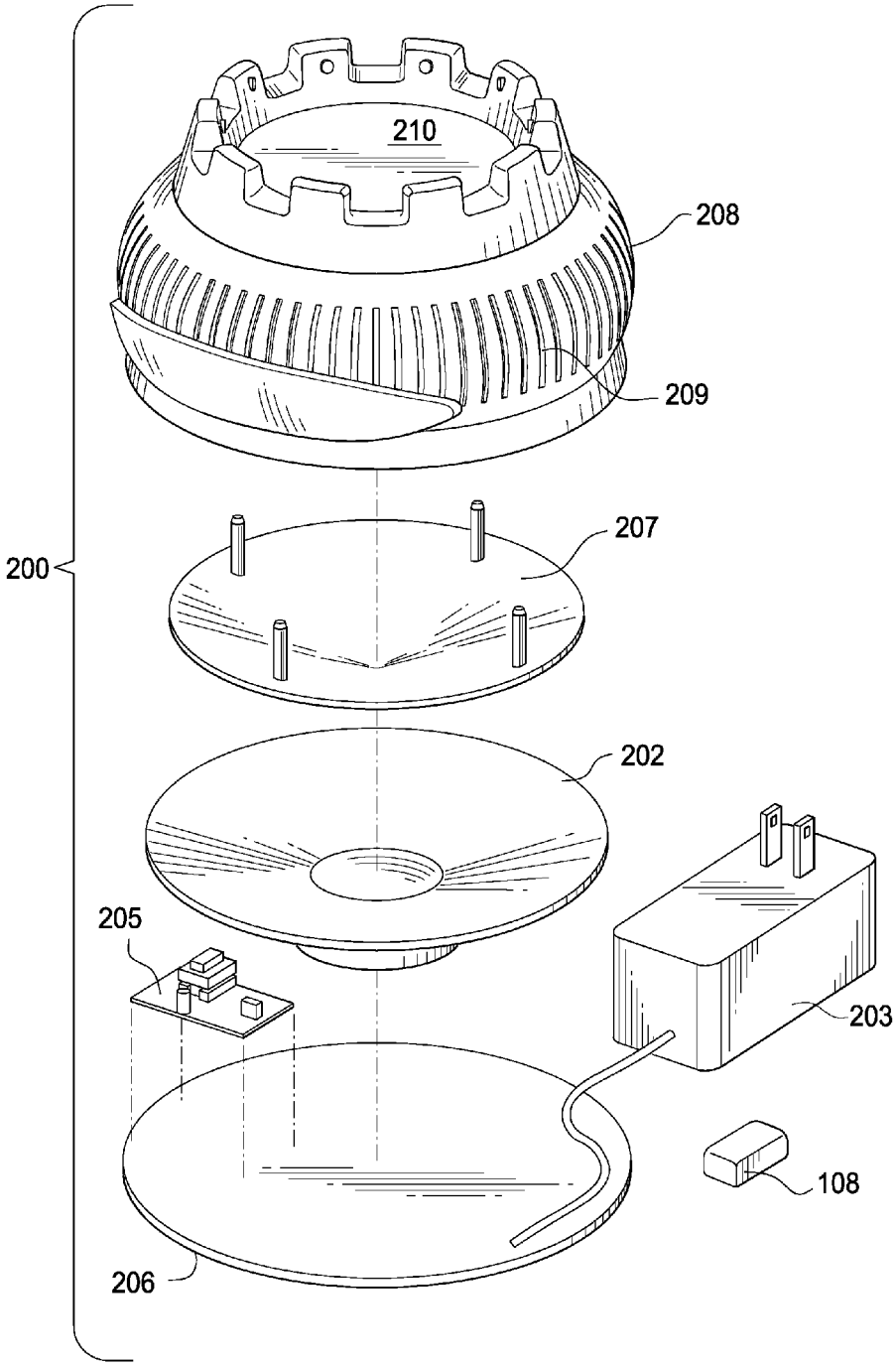
FIG. 4 is an exploded view of the display stand.

FIGS. 3 and 4 show the components of the display stand 200. The display stand 200 has a base with a circuit board 205 including an audio playback device. The circuit board includes all of the control circuitry to control the audio playback device, the lights and to receive the signals from the remotes 108. If desired, the circuit board 205 can be connected to a larger external control system that connects into the ordering system of the establishment and/or to a control panel as mentioned above. In the depicted embodiment the audio playback device is an integrated circuit board, but other audio playback devices could be used as well. A speaker 202 is operably attached to the audio playback device to amplify the sound. A sound deflection disc 207 is used in the depicted embodiment to deflect the sound from the speaker 202 from being directed primarily upward to radiating outward from the speaker 202. Other arrangements of the direction of the speaker or speakers could be used depending on the particular configuration of the speaker or speakers in a given stand 200. Depending on the configuration of the speaker(s) and the room the display stand 200 is to be used in, the sound deflection disc may not be required in a given embodiment.

A cover 208 with openings 209 goes over the speaker 202 and attaches to base 206. The arrangement of the openings 209 will depend on the location and arrangement of the speaker. The opening 209 could be covered with fabric or foam, as is well known in the speaker art. The cover 208 can have a platform 210 to place the bottle 103 on.

As noted above, the display stand 200 can be connected to a control panel either directly or on the separate control box could to show the server which table and/or customer number has ordered a given beverage. Additionally, either the chiller 100 or the display stand 200 could be programmed to interact with a computer order control system used in many bars and restaurants directly such that the use of the remote would function to enter the drink order directly into the computer system.

The remote 108 can be shaped as a small key fob, as shown in the depicted embodiments, or can be in any number other desired configurations. It can be incorporated into some other useful device, such as a pen, flash drive or any other device or can be incorporated into a piece of jewelry, such as a lapel pin, watch or bracelet. The exterior of the remote 108 can be designed to invoke the brand being promoted, the type of beverage, the location or the event, depending on use. For example, at a sporting event, the remote could be the local team logo or mascot. Remotes with different control levels could have different exterior designs, so allow them to be visually distinguished by staff at the location. For example, VIP's could be issued one type of remote and standard patrons a different remote. VIP's could be give remotes that corresponded to the preferred brand of beverage of the VIP, so that the staff would know as soon as the VIP entered the premises what the VIP's preferred beverage is so that it can be prepared and waiting for the VIP. The remotes could also incorporate a sound or light display as desired.

Figure 5:
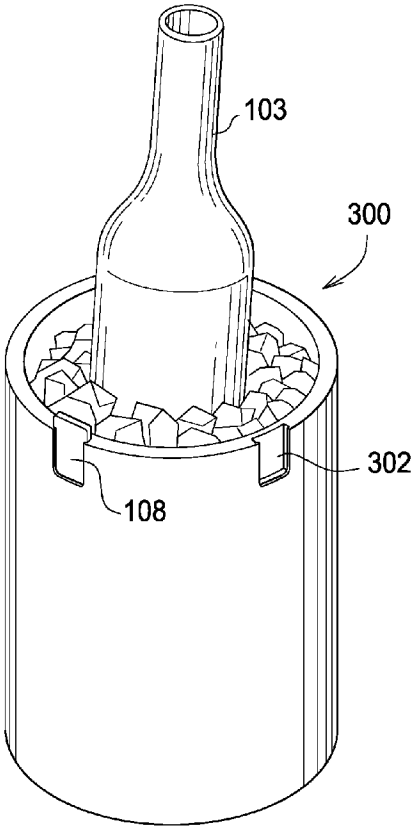
FIG. 5 is a perspective view of a ice bucket incorporating docking stations for remotes.

In many locations, there are private rooms that are reserved for private parties and/or VIPs. In such rooms a table center piece could be provided, such as an ice bucket 300 as seen in FIG. 5. The center piece can have locations 302 that allow a user to attach the remotes 108 to the center piece to make them easy to use during the evening to order more beverages. The locations 302 can have electrical contacts and/or data ports to allow the remotes to be re-charged and to have a direct wired communication to the control center of the establishment. The remote 108 could be updated during this time with new chances to win any prize, new free offers or any other information desired. The individual ID of the remote 108 can be used to track the preferences of the use If desired, data can be collected on which remotes have been used and how often, either to track preferred customers, or to ensure compliance with alcoholic beverage serving limits. Collecting the data for which remotes have been used and transmitting it by known means to a central location would allow a brand owner to track the success of various promotion efforts to learn what promotion efforts are a within desired parameters and which are not achieving the promotion goals of the brand owner. This allows the brand owner to rapidly collect data and modify marketing campaigns as needed on a much shorter schedule that many marketing efforts currently allow. For example, a brand owner could place a display stand units 200 in a number of bars spread out over a given geographic area and then do different types of promotions at or near the different bars and track the use of the remotes 108 and/or the consumption of the beverage at a given bar over time to track what types of promotions are resulting in use of the remotes. Then the consumption rates of the beverage at these bars after the promotion can be tracked to see if the promotion and use the remotes 108 results in additional long term sales of the beverage. The results of sales a local liquor stores could be tracked as well, to see if promotions result in direct to consumer sales of the beverage as well.

While a number of exemplary aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations are within their true spirit and scope. Each apparatus embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims. Whenever a range is given in the specification, all intermediate ranges and subranges, as well as all individual values included in the ranges given are intended to be included in the disclosure. In general the terms and phrases used herein have their art-recognized meaning, which can be found by reference to standard texts, journal references and contexts known to those skilled in the art. The above definitions are provided to clarify their specific use in the context of the invention.

I claim:

1. A device for promoting the consumption of a beverage comprising:

a display device having a light display mechanism that is tied to a chosen display theme;

a control device for the light display that is capable of receiving a remote signal to activate a light display;

an audio playback device and a speaker, the audio playback device having a control device that can be activated by a remote signal and an audio track that is ties to the chosen display theme;

at least one hand held wireless remote control device separate from the device to send a wireless remote signal to the device to activate at least one of the light or audio display;

the wireless remote control devices being retained by a customer of an establishment having a device and the wireless remote control devices being brought to the establishment by the customer;

the device having a means to sense when a wireless remote control device has entered the establishment; and the device, the hand held wireless remote control and the displays are all coordinated to a chosen theme to promote brand loyalty.

2. The device of claim 1 further comprising:

a location to hold a container of the beverage, such that the container is prominently displayed to potential customers and attention is attracted to the beverage container when a light or sound display occurs.

3. The device of claim 1 further comprising:

a cooling device to chill the beverage to a desired temperate before the beverage is dispensed.

4. The device of claim 1 further comprising:

the device producing a light and/or sound display when a beverage is dispensed.

5. The device of claim 1 further comprising:

a table decoration having a least one docking station for at least one remote.

6. The device of claim 1 further comprising:

least one remote having a sound and/or light display mechanism.

7. The device of claim 1 further comprising:

at least two different types of remotes, the device having a mechanism to distinguish between the different types of remotes and the device signaling a user of the device when at least one of the types of remotes enters the establishment.

8. The device of claim 7 further comprising:

at least a portion of the remotes can be redeemed for a prize.

9. The device of claim 1 further comprising:

a means of tracking how many different remotes have been used during a chosen period of time.

10. The device of claim 1 further comprising:

a control box having a display to inform a serving person of what remote has been activated.

11. A method for promoting the consumption of a beverage comprising the steps of:

providing a display device having a light display mechanism that is tied to a chosen display theme at an establishment serving the beverage;

providing a control device for the light display that is capable of receiving a remote signal to activate a light display;

providing an audio playback device and a speaker, the audio playback device having a control device that can be activated by a remote signal and an audio track that is ties to the chosen display theme;

providing at least one hand held wireless remote control device separate from the device;

a customer of the establishment retaining when they are not at the establishment, and the wireless remote control devices being brought to the establishment by the customer;

the device sensing when a wireless remote control device has entered the establishment;

sending a wireless remote signal to the device activating at least one of the light or audio display; and coordinating the device, the hand held wireless remote control and the displays to a chosen theme to promote brand loyalty.

12. The method of claim 11 further comprising the steps of:

providing a location to hold a container of the beverage, such that the container is prominently displayed to potential customers and attention is attracted to the beverage container when a light or sound display occurs.

13. The method of claim 11 further comprising the steps of:

cooling the beverage to a desired temperate before the beverage is dispensed.

14. The method of claim 11 further comprising the steps of:

the device producing a light and/or sound display when a beverage is dispensed.

15. The method of claim 11 further comprising the steps of:

providing a table decoration having a least one docking station for at least one hand held wireless remote.

16. The method of claim 11 further comprising the steps of:

least one hand held wireless remote having a sound and/or light display mechanism.

17. The method of claim 11 further comprising the steps of:

having at least two different types of remotes, the device distinguishing between the different types of remotes and the device informing an operator when at least one type of the remotes enters the premises.

18. The method of claim 17 further comprising the steps of:

redeeming a portion of the remotes for a prize.

19. The method of claim 11 further comprising the steps of:

tracking how many different remotes have been used during a chosen period of time.

20. The method of claim 11 further comprising the steps of:

providing control box having a display to inform a serving person of what remote has been activated.

* * * * *